US006097415A

United States Patent [19]

Kita et al.

[11] Patent Number: 6,097,415

[45] **Date of Patent: *Aug. 1, 2000**

[54] THERMAL TRANSFER RECORDING METHOD AND APPARATUS UTILIZING INTERMEDIATE TRANSFER RECORDING MEDIUM

[75] Inventors: Tatsuya Kita; Takeshi Ueno; Naoji Shibasaki, all of Tokyo-to, Japan

[73] Assignee: Dai Nippon Printing Co., Ltd., Tokyo-to, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/856,852

[22] Filed: May 15, 1997

[30] Foreign Application Priority Data

May 16, 1996 [JP] Japan ..... 8-144894

[51] Int. Cl.[7] ..... B41J 2/32

[52] U.S. Cl. ..... 347/213

[58] Field of Search ..... 347/171, 172, 347/213, 218, 193; 400/120.13, 635

[56] References Cited

U.S. PATENT DOCUMENTS

| | | | |
|---|---|---|---|
| 4,458,253 | 7/1984 | Goff, Jr. et al. | 347/176 |
| 4,907,034 | 3/1990 | Doi et al. | 355/327 |
| 5,448,282 | 9/1995 | Imai et al. | 347/213 |
| 5,500,667 | 3/1996 | Schwiebert et al. | 347/102 |

FOREIGN PATENT DOCUMENTS

| | | | |
|---|---|---|---|
| 1-262172 | 10/1989 | Japan | B41J 13/10 |
| 3-2070A | 8/1991 | Japan | B41J 2/32 |
| 0038176 | 10/1981 | United Kingdom | B41J 1/46 |

*Primary Examiner*—N. Le
*Assistant Examiner*—Anh T. N. Vo
*Attorney, Agent, or Firm*—Ladas & Parry

[57] ABSTRACT

A thermal transfer recording system, there is prepared a thermal transfer sheet such as a sublimation or heat fusion thermal transfer sheet, and also prepared an intermediate transfer recording medium comprising a substrate sheet and a receptor layer disposed on the substrate sheet so as to be transferable; the thus prepared thermal transfer sheet is disposed together with the intermediate transfer recording medium between a heating device such as a thermal head and a platen roller; the thermal head is heated in accordance with an image information to be printed to thereby form the image in the receptor layer of the intermediate transfer recording medium; and thereafter, the image is transferred together with the receptor layer to a transfer-receiving material. When the image is formed to the intermediate transfer recording medium, the intermediate transfer recording medium is pressed at least at one area thereof from front surface side and back surface side thereof so as to fix a relative positional relationship between both ends in a width direction of the intermediate transfer recording medium, to thereby prevent shrinkage of the intermediate transfer recording medium in the width direction thereof.

14 Claims, 8 Drawing Sheets

THERMAL TRANSFER RECORDING METHOD AND APPARATUS UTILIZING INTERMEDIATE TRANSFER RECORDING MEDIUM

BACKGROUND OF THE INVENTION

The present invention relates to thermal transfer recording method and apparatus in which an image transferred to an intermediate transfer recording medium by utilizing a thermal transfer recording system is further transferred to a transfer-receiving material, thereby transferring and recording the image to the transfer-receiving material, and more particularly, relates of thermal transfer recording method and apparatus capable of well reproducing a color image having an improved color discrepancy.

In the known art, there have been provided various thermal transfer recording methods in which a thermal transfer sheet provided with a substrate sheet having one surface on which a color material layer is formed and a transfer-receiving material having a receptor layer, as occasion demands, are press-contacted between a heating device such as thermal head and a platen roller, a heating portion of the heading device is selectively heated in response to an image information, and a color material of the color material layer is transferred to the transfer-receiving material, thereby recording the image having predetermined information. In these thermal transfer recording methods, in recent years, a heat sensitive fusion transfer system and a heat sensitive sublimation transfer system have been most widely utilized.

The heat sensitive fusion transfer system is an image recording method which utilizes a thermal transfer sheet provided with a substrate sheet such as plastic film having a heat fusible ink layer, as a color material layer, formed by dispersing the color material such as pigment into a heat fusible binder such as wax or resin, and in which a thermal energy in response to an image information is applied by a heating device such as thermal head, to thereby transfer the color material together with the binder onto a transfer-receiving material such as paper or plastic sheet. An image obtained through this heat sensitive fusion transfer method has a high density and an excellent color clearness and thus, is suitable for the recording of binary images such as letters or lines.

On the other hand, the heat sensitive sublimation transfer system is an image recording method which utilizes a thermal transfer sheet provided with a substrate sheet such as plastic film having a dye layer, as a color material layer, formed by fusing or dispersing a sublimate dye as color material into a binder resin and a transfer-receiving material provided with a support member such as paper or plastic sheet having a receptor layer for color material, and in which a thermal energy in response to an image information is applied by a heating device such as thermal head, to thereby transfer only the color material in the color material layer of the thermal transfer sheet onto the receptor layer of the transfer-receiving material to thereby record the image.

In these transfer methods, a multi-color or color image can be recorded by utilizing thermal transfer sheets such as yellow, magenta, cyan and black color sheets and recording on the transfer-receiving material in an overlapped manner.

In these transfer recording systems, however, particularly, in the heat sensitive sublimation transfer system, it is necessary for an image formation surface of the transfer-receiving material to have a dying property to a dye as a color material, and it is almost impossible to form an image on the transfer-receiving material provided with no receptor layer having the dying property. In such view, in order to form, through the heat sensitive sublimation transfer system, an image to the transfer-receiving material other than a specific paper preliminarily formed with the receptor layer, the prior art provides a technique in which a receptor layer transfer sheet having a substrate film to which a receptor layer is formed to be peelable therefrom is prepared, and the receptor layer is transferred to the transferreceiving material, and the color material is transferred from the thermal transfer sheet onto the transferred receptor layer, thus forming the image on the transfer-receiving material. Such technology is disclosed, for example, in Japanese Patent Laid-open Publication No. SHO 62-264994. According to this transfer system, the receptor layer which has been transferred to the transfer-receiving material is largely subjected to an influence with a surface quality of the transfer-receiving material. That is, there may be caused a problem in which the receptor layer is not formed to a recessed portion of the surface of the transfer-receiving material or the receptor layer becomes irregular because of an irregularity of the surface of the transfer-receiving material, leading to irregularity of a formed image. Accordingly, in the known art, it is necessary to select the transfer-receiving material having a flat smooth surface condition to obtain a desired fine image.

Thus, in order to prevent the adverse influence to the image quality with the surface irregularity or surface condition of the transferreceiving material and to make possible the formation of the image on an optional transfer-receiving material, in the known art, an intermediate transfer recording medium, in which the receptor layer is formed on a substrate sheet to be peelable, is first prepared, an image is formed on this receptor layer through the heat sensitive sublimation transfer system with the use of the thermal transfer sheet, and the intermediate transfer recording medium formed with such an image is then overlapped with the transfer-receiving material and heated to thereby transfer the receptor layer in which the image is already formed onto the transfer-receiving material. Such technology is disclosed, for example, in Japanese Patent Laid-open Publication No. SHO 62-238791.

FIG. 20 is an illustration showing a schematic structure of a conventional thermal transfer recording apparatus 200 utilizing the intermediate transfer recording medium mentioned above. With reference to FIG. 20, an intermediate transfer recording medium 1 having a long scale and a thermal transfer sheet 2 also having a long scale are fed and conveyed from supply rolls 31 and 33, respectively, press-contacted together by a first thermal head 4 and a first platen roller 5 at a printing section, and a thermal energy is applied in accordance with an image information by the first thermal head 4. Through these processes, a color material of the thermal transfer sheet 2 is transferred to a receptor layer of the intermediate transfer recording medium 1 to form an image A, and the thermal transfer sheet 2 is thereafter rolled up around a wind-up roll 34. Then, the intermediate transfer recording medium on which the image A has been formed is continuously conveyed to a transfer section, in which the intermediate transfer recording medium and the transfer-receiving material B are pressed together by a second thermal head 4*a* and a second platen roller 5*a*. Through the heating process of the second thermal head 4*a*, the receptor layer on which the image has been formed is transferred to the transfer-receiving material B, and after this transfer process, the intermediate transfer recording medium is wound up around the wind-up roll 32. Further, it is to be noted that although transferring width and length of the second thermal head 4*a* as a heating means for transferring the receptor layer from the intermediate transfer recording medium to the transfer-receiving material can be optionally set, a heating roller may be utilized in a case where optional setting to every image is not required.

Incidentally, in order to accommodate the intermediate transfer recording medium in a thermal transfer recording apparatus as much in volume as possible and to reduce a material cost, it is desired to use a thin film as a substrate sheet of the intermediate transfer recording medium. However, when the thin film is used, because the thin film is generally manufactured by being elongated in vertical and horizontal directions, a thermal shrinkage will be caused when exposed to high temperature condition after the manufacture thereof. A like phenomenon will be caused in a case where the thin film is used for the substrate sheet of the intermediate transfer recording medium, and a thermal shrinkage will be also caused through the heating by the thermal head at a time when an image is formed to the receptor layer of the intermediate transfer recording medium. Particularly, in the recording of a color image, since the color image is displayed by overlapping respective images of yellow, magenta and cyan colors, it is required to accurately accord with the respective color images in positions, and if such positioning is not accurate, a displayed image provides a bad appearance. If the substrate sheet of the intermediate transfer recording medium is shrunk every time when the images of the respective colors are formed on the receptor layer of the intermediate transfer recording medium, the respective color images differ in their sizes and it becomes impossible to accurately overlap these images with each other.

Although the shrinkage or elongation in the length direction, i.e. conveying direction of the intermediate transfer recording medium, can be controlled by adjusting tension to be applied in the length direction thereof at the conveying time, any tension is not applied, in usual, in the width direction, i.e. a direction normal to the conveying direction, it is difficult to prevent the shrinkage or elongation of the substrate sheet in the width direction. For example, in a case where a three-color (YMC) image is formed to the intermediate transfer recording medium using a polyethylene terephthalate film having a thickness of 10 $\mu$m, shrinkage of about 0.6–1.0 mm is caused with respect to the width of 180 mm, which corresponds to the shifting of 8–13 dots at a picture element density of 12 dots/mm, and this shifting amount can be not neglected for the color reproduction of a clear image.

SUMMARY OF THE INVENTION

An object of the present invention is to substantially eliminate defects or drawbacks encountered in the prior art described above and to provide thermal transfer recording method and apparatus capable of preventing shrinkage or elongation in a width direction of an intermediate transfer recording medium having a thin substrate film, and accurately overlapping respective color images.

This and other objects can be achieved according to the present invention by providing, in one aspect, a thermal transfer recording method comprising the steps of:

preparing a thermal transfer sheet comprising a substrate sheet and a color material layer for transferring a color material through either one of sublimation transfer process and heat fusion transfer process which is disposed on one surface of said substrate sheet, and preparing an intermediate transfer recording medium comprising another substrate sheet and a receptor layer disposed on one surface of said another substrate so as to be transferable;

disposing the thus prepared thermal transfer sheet together with the intermediate transfer recording medium between a heating means and a platen roller under pressure so that the color material layer and the receptor layer are overlapped;

heating the heating means in accordance with an image information to be printed to thereby transfer at least the color material of the color material layer to the receptor layer to form an image thereto; and transferring the image together with the receptor layer to a transfer-receiving material, wherein the intermediate transfer recording medium is pressed at least at one area thereof from front surface side and back surface side thereof so as to fix a relative positional relationship between both ends in a width direction of the intermediate transfer recording medium at a time when the image is formed to the intermediate transfer recording medium, to thereby prevent shrinkage of the intermediate transfer recording medium in the width direction thereof.

In preferred embodiments, at least two pairs of nip rollers are disposed so that each pair of nip rollers are positioned at upstream and downstream sides from a portion, at which the image is formed to the intermediate transfer recording medium, along an intermediate transfer recording medium conveying direction, the nip rollers being arranged so as to nip the intermediate transfer recording medium from the front surface and the back surface sides thereof, to thereby prevent the shrinkage of the intermediate transfer recording medium in the width direction thereof. The two pairs of nip rollers may be arranged to be substantially normal to the intermediate transfer recording medium conveying direction.

In another preferred embodiments, the intermediate transfer recording medium is conveyed while pressing at portions near the width directional ends of the intermediate transfer recording medium so as to fix a width directional distance thereof, to thereby prevent the shrinkage of the intermediate transfer recording medium in the width direction thereof.

In still another preferred embodiments, the intermediate transfer recording medium is pressed at portions near both the width directional ends thereof while applying a width directional tension to the intermediate transfer recording medium, to thereby prevent the shrinkage of the intermediate transfer recording medium in the width direction thereof. In such an embodiment, the intermediate transfer recording medium may be pressed at the above-described portions while applying the above-described tension by two pairs of nip rollers which are arranged to provide inclinations with respect to the intermediate transfer recording medium conveying direction.

In another aspect, there is provided a thermal transfer recording apparatus comprising:

a conveying means for conveying a thermal transfer sheet comprising a substrate sheet and a color material layer for transferring a color material through either one of sublimation transfer process and heat fusion transfer process which is disposed on one surface of said substrate sheet;

another conveying means for conveying an intermediate transfer recording medium comprising another substrate sheet and a receptor layer disposed on one surface of said another substrate sheet so as to be transferable;

a heating means for pressing said thermal transfer sheet and said intermediate transfer recording medium against a platen roller so as to be overlapped with each other and generating a heat in accordance with an information of an image to be printed to thereby transfer at least the color material of the color material layer to the receptor layer, thereby forming the image thereon;

a transferring means for transferring the image formed on the receptor layer together therewith on a transfer-receiving material; and a shrinkage preventing means for preventing shrinkage of the intermediate transfer recording medium in the width direction thereof by pressing the intermediate transfer recording medium at least at one area thereof from front surface side and back surface side thereof so as to fix a relative positional relationship between both ends in a width direction of the intermediate transfer recording medium at a time when the image is formed to the intermediate transfer recording medium.

According to preferred embodiments of the present aspect, there is adapted various types of the shrinkage preventing means. For example, the shrinkage preventing means comprises at least two pairs of nip rollers disposed so that each pair of nip rollers are positioned at upstream and downstream sides from said heating means along the intermediate transfer recording medium conveying direction, said nip rollers being arranged to be substantially normal to the intermediate transfer recording medium conveying direction so as to nip, while rotating, the intermediate transfer recording medium from the front surface and back surface sides thereof.

In another preferred embodiment, the shrinkage preventing means comprises at least two pairs of fixing plates which nip the intermediate transfer recording medium at portions near width directional ends thereof and which are movable in parallel to the intermediate transfer recording medium conveying direction in accordance with the conveyance thereof.

In still another preferred embodiment, the shrinkage preventing means comprises at least two pairs of belts which nip the intermediate transfer recording medium at portions near width directional ends thereof and which are rotatable in parallel to the intermediate transfer recording medium conveying direction in accordance with the conveyance thereof.

In further another preferred embodiment, the shrinkage preventing means comprises at least two pairs of nip rollers slidably rotatable in directions towards both ends of the intermediate transfer recording medium while nipping the same at portions near width directional ends to thereby applying a width directional tension to the intermediate transfer recording medium. In such an embodiment, the two pairs of nip rollers are arranged so as to provide inclinations with respect to the intermediate transfer recording medium conveying direction.

According to the characters and structures of the present invention described above, the intermediate transfer recording medium is pressed at least at one area thereof from the front surface and the back surface sides thereof so as to fix a relative positional relationship between both ends in a width direction of the intermediate transfer recording medium, being capable of preventing shrinkage or elongation in a width direction of the intermediate transfer recording medium having the thin substrate film and accurately overlapping respective color images.

The nature and further characteristic features of the present invention will be made more clear from the following descriptions made with reference to the accompanying drawings.

BRIEF DESCRIPTION OF THE DRAWINGS

In the accompanying drawings:

FIG. 3 is a schematic sectional view, partially cut away, showing an arrangement of a thermal transfer recording apparatus for performing a thermal transfer recording method according to a second embodiment of the present invention, in which

DESCRIPTION OF THE PREFERRED EMBODIMENTS

Figure 1:
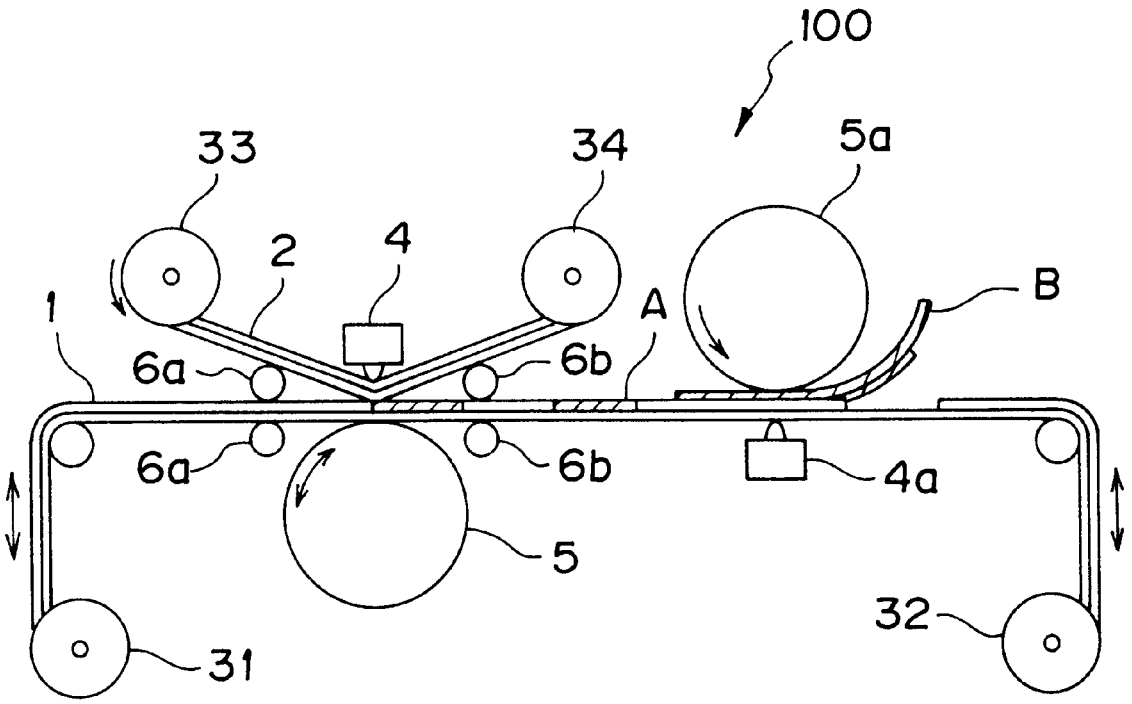
FIG. 1 is a schematic sectional view showing a general arrangement of a thermal transfer recording apparatus for performing a thermal transfer recording method according to a first embodiment of the present invention.

The thermal transfer recording method and apparatus according to the present invention will be described hereunder by way of preferred embodiments with reference to the accompanying drawings in which like reference numerals are commonly applied to corresponding to portions and members in the respective embodiments.

Figure 2:
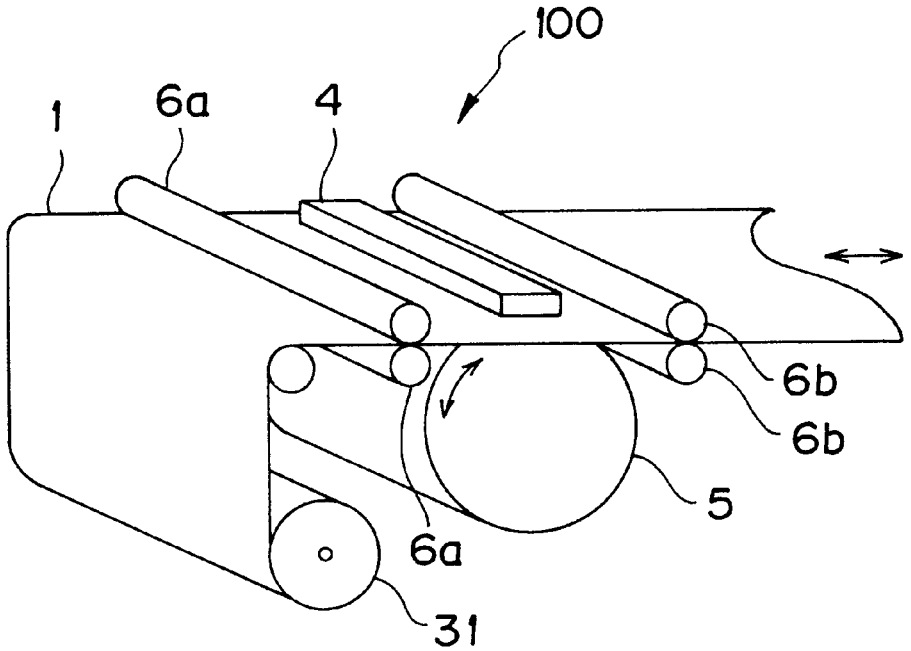
FIG. 2 is a perspective view showing an important portion of the apparatus shown in FIG. 1.

A first embodiment of the present invention will be first described below with reference to FIGS. 1 and 2, in which FIG. 1 is a sectional view showing a schematic structural arrangement of a thermal transfer recording apparatus and FIG. 2 is a perspective view of a printing section for recording an image onto an intermediate transfer recording medium, and a thermal transfer sheet in FIG. 1 is not shown in FIG. 2.

A thermal transfer recording apparatus 100 of FIG. 1 of the present invention has an arrangement, in comparison with a conventional apparatus, in which a thermal head 4 as a selective heating means for transferring an image to an intermediate transfer recording medium 1 at a printing section is disposed, and two pairs 6*a*, 6*b* of nip rollers are disposed so as to one pair (6*a* or 6*b*) of nip rollers are arranged to each of the front and the rear portions of the thermal head 4. The intermediate transfer recording medium 1 is conveyed while being nipped from its front surface side and back surface side by these two pairs of nip rollers 6*a* and 6*b*, to thereby prevent the intermediate transfer recording medium from being shrunk in a width direction thereof.

Referring to FIGS. 1 and 2, the intermediate transfer recording medium 1 is supplied from an intermediate transfer recording medium supply roll 31, conveyed through a platen roller 5 in a printing section and a transferring section for a transfer-receiving material, and then rolled up around an intermediate transfer recording medium wind-up roll 32. That is, the intermediate transfer recording medium conveying means of the thermal transfer recording apparatus 100 at least comprises the supply roll 31, the platen roller 5 and the wind-up roll 32. These rolls and roller are connected to reversible rotational shafts, not shown, respectively.

A thermal transfer sheet 2 is conveyed by means of a thermal transfer sheet conveying means. That is, the thermal transfer sheet 2 is supplied from a thermal transfer sheet supply roll 33, conveyed through the printing section for the intermediate transfer recording medium, and then rolled up around a thermal transfer sheet wind-up roll 34 connected to a rotational drive shaft, not shown. The thermal transfer sheet 2 has a substrate sheet on which color material layers of yellow, magenta and cyan colors and a black color optionally added are formed for a color image recording, these layers being sectioned in a predetermined order in the longitudinal direction thereof. In the case of the color image recording, the intermediate transfer recording medium 1 is returned back to the initial printing position at a time when the printing of the first color has been completed and the supply roll 31 has been reversely rotated, and then takes a stand-by position for the next color printing. The supply roll 31 of the intermediate transfer recording medium 1 may be provided with a brake mechanism, not shown, for applying a proper tension in the longitudinal direction, i.e. a direction parallel to the conveying direction, to the intermediate transfer recording medium 1 at the time of printing.

The thermal head 4 as a selective heating means for the printing section is a line thermal head in this embodiment, and acts to press the conveyed thermal transfer sheet 2 and the intermediate transfer recording medium 1 in an overlapped manner and to generate heat in accordance with image information, to thereby form an image A by transferring at least color material from the color material layers of the thermal transfer sheet 2 to a receptor layer of the intermediate transfer recording medium 1. In the sublimation transfer recording system, a sublimation dye is transferred as the color material. Further, in the fusion transfer recording system, color material and a binder containing a dispersed color material, i.e. a color material layer, are transferred.

As the shrinkage preventing means, a pair of rotatable nip rollers (6*a*/6*a* or 6*b*/6*b*) are disposed at each of the front and rear positions of the location of the thermal head 4 in a fashion approximately perpendicularly to the conveying direction of the intermediate transfer recording medium 1, each pair of the nip rollers 6*a*/6*a* and 6*b*/6*b* serving to nip the intermediate transfer recording medium 1 from the front surface side and the back surface side thereof.

A pair of nip rollers 6*a*/6*a* and another pair of nip rollers 6*b*/6*b* are disposed on the upstream side and the downstream side of the intermediate transfer recording medium 1 with respect to a portion at which heat is applied. These nip rollers 6*a* and 6*b* may be a roller formed of a metallic material such as iron or stainless steel, a roller formed by covering a metallic core with an elastic material such as rubber or sponge, a roller formed by coating a metallic or rubber surface with a resin or the like, or a roller formed by covering a metallic or rubber surface by a resin tube. The nip rollers may be further formed with different materials such that one side, for example, the rollers for the front surface side may be formed of the metallic material, and the rollers for the back surface side may be formed of the rubber material. When the nip rollers are formed of a material having elasticity, the intermediate transfer recording medium 1 is pressed from the front surface and back surface sides thereof by the elasticity of the nip rollers, whereas, when the nip rollers are formed of a material having no elasticity, the intermediate transfer recording medium 1 is pressed from the front surface and back surface sides thereof by a spring force of springs, not shown, connected to the rotational shafts thereof. Although the nip rollers 6*a* and 6*b* may have a structure to be slidable as well as rotatable with respect to the intermediate transfer recording medium, it is preferred only to be rotatable for suitably preventing the shrinkage thereof.

It is also preferred that the nip rollers are arranged to positions as possible as near the printing section composed of the thermal head 4 and the platen roller 5, namely a heater line position of the thermal head, in the viewpoint of the shrinkage prevention effect. For this reason, it will be preferred to use a corner-type or end-face-type thermal head because such type thermal head has less size in the conveying direction. Further, it is not necessary to make equal distances between the upstream side nip rollers and the thermal head and between the downstream side nip rollers and the thermal head, and it is desired to make small each of these distances possibly. In an arrangement in which the nip rollers are not located on both sides and located on only one side of the upstream and downstream sides, it is desired to locate the nip rollers on the downstream side on which residual heat remains for achieving a desired effect. Furthermore, it may be not necessary to nip the intermediate transfer recording medium in the entire width length thereof, and partially nipping of the same is permitted. For example, the central ⅓ part of the intermediate transfer recording medium is not nipped and both end side ⅓ parts are nipped, and in such case, it is desired to nip both the sides thereof but not one side thereof. In this arrangement, since the central portion of the intermediate transfer recording medium is not contacted to the nip rollers, the intermediate transfer recording medium 1 can be prevented from being contaminated or damaged by dirts or the like adhering to the nip roller surfaces. Further, an optional type driving means for rotating the nip rollers may be adapted.

The intermediate transfer recording medium 1 having the image A formed by overlapping a plurality of color images corresponding to the desired color numbers through the repeated forward and backward movements thereof is then conveyed to the transferring section, in which the intermediate transfer recording medium is overlapped with a transfer-receiving material B, which are then pressed against the platen roller 5*a* by means of a second thermal head 4*a* so as to transfer only the receptor layer of the intermediate transfer recording medium on which the image has been formed to the transfer-receiving material B, thus forming a final image on the transfer-receiving material. Although the second thermal head 4*a* as a heating means for transferring the receptor layer on which the image has been formed to the transfer-receiving material can be set its transferring width or length, a heating roller may be utilized in a case where an optional setting thereof for every image is not needed.

In the thermal transfer recording apparatus 100 of FIG. 1, the receptor layer is transferred to the sheet-like transfer-receiving material B by the transferring means composed of the thermal head 4*a* and the platen roller 5*a*. An ordinary paper or plastic film may be utilized as the sheet-like transfer-receiving material B. According to the present invention, it is of course possible to transfer the receptor layer to the surface of a transfer-receiving material having no sheet shape such as bottle or like by using an appropriate transferring means.

According the first embodiment of the present invention, the shrinkage of the intermediate transfer recording medium can be suppressed by an amount approximately a half in the conventional structure such as mentioned below.

Figure 21:
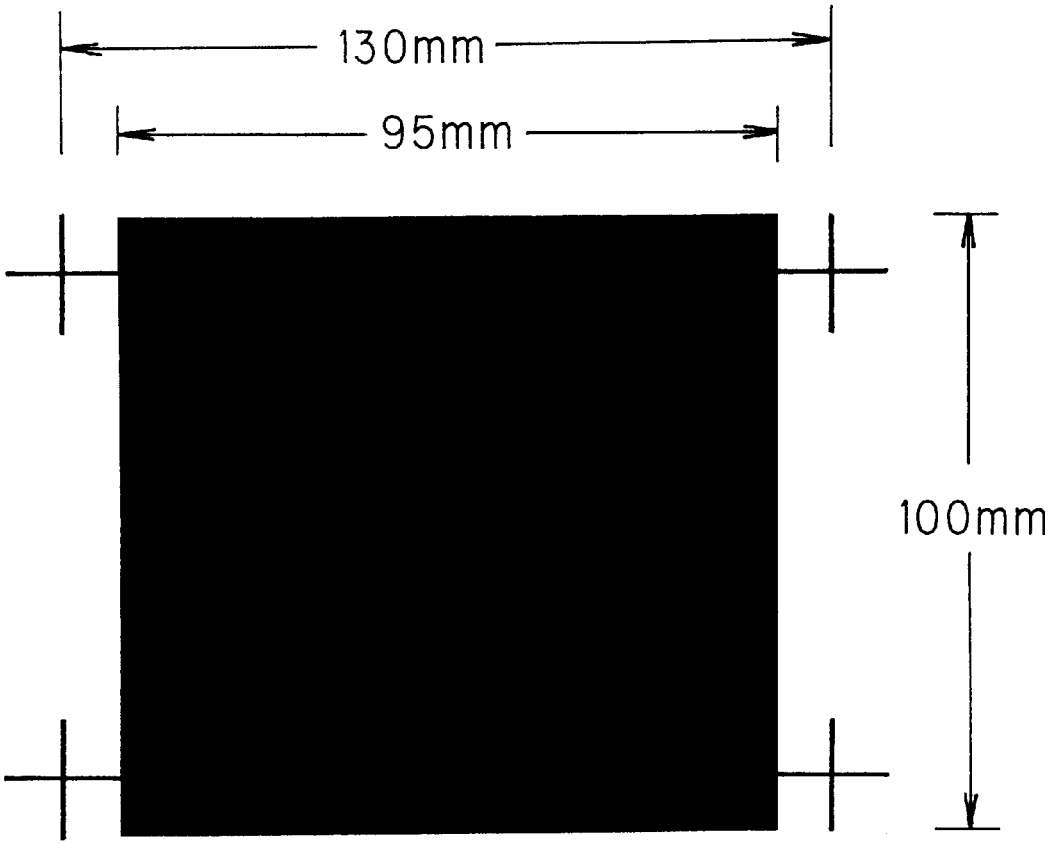
FIG. 21 is a explanatory view showing a printing test in the first embodiment.

In the first embodiment of the present invention, the intermediate transfer recording medium was prepared by forming a receptor layer having a width of 220 mm to a polyethylene terephthalate film (K203, manufactured by Diafoil Hoechest Co., Ltd.) having a thickness of 12 $\mu$m. Nip rollers were arranged to positions apart, by 80 mm in front and rear directions respectively, from a thermal head (KGT-219-12MPL27, average resistance of about 3300 Ω, manufactured by Kyosera Co., Ltd.). As shown FIG. 21, sublimation images of the three colors of Y, M and C (transverse width 95 mm×longitudinal length 100 mm) were formed in this order on the central portion in the width direction of the intermediate transfer recording medium, and superimposed over each other. These respective images were formed as uniform concentration image having gradient value of 63 with respect to the maximum gradient value of 255, with voltage of 18.5 V applied by the thermal head, printing cycle of 10 ms/line, pulse duty ratio of 100% and applied energy of about 74.49 mJ/mm$^2$. Shifting in dots of cross-shape marks, provided at four corner portions of a square solid print, of each color image having transverse width of 130 mm was measured. As a result, it was found that the colors Y and C were most shifted, and the shifting of 8–13 dots in the case of no nip roller could be suppressed to 5–7 dots in the presence of the nip rollers (12 dots/mm pixel density).

In the viewpoint of the transverse shrinkage prevention, although the effects and functions of the embodiments mentioned hereinlater, in which both the ends of the intermediate transfer recording medium are fixed, may be easily understandable directly and straightly, and the effects and functions of the first embodiment is not easily understandable because, according to the first embodiment mentioned above, the intermediate transfer recording medium is fixed to its front and rear side portions on the upstream and downstream sides, the superior effects and functions were attained when the method of the above-mentioned first embodiment was executed. Moreover, in the first embodiment, it is not necessary to set any blank portion for fixing the intermediate transfer recording medium at its both ends, and the size of the intermediate transfer recording medium can be easily downsized and the simple structure of the thermal transfer recording apparatus can be adapted, thus being advantageous.

The second embodiment of the present invention will be described hereunder with reference to FIGS. 3 to 6.

Figure 4:
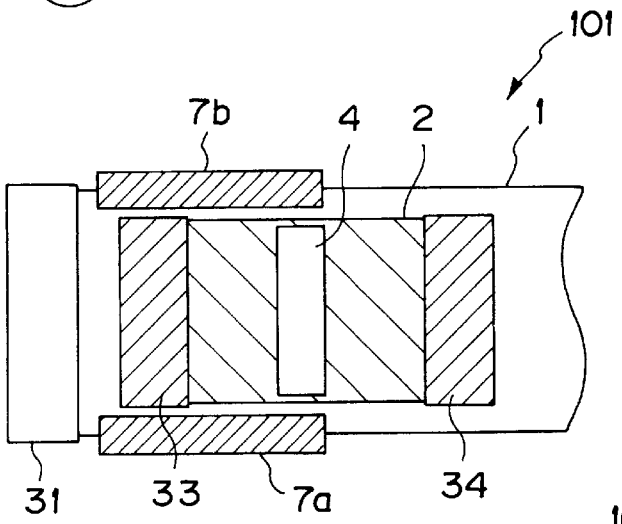
FIG. 4 is a plan view showing an important portion of the apparatus of FIG. 3.
Figure 5:
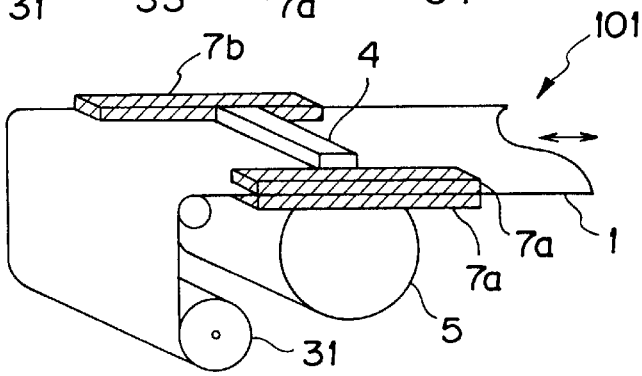
FIG. 5 is a perspective view showing an important portion of the apparatus of FIG. 3.
Figure 6:
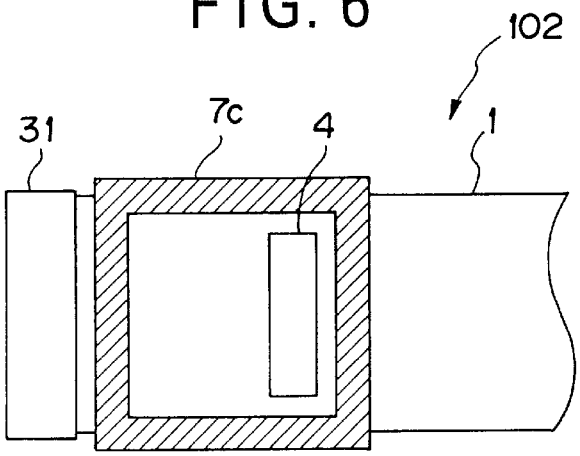
FIG. 6 is a plan view showing an important portion of a modification of the second embodiment.

In the method of the second embodiment, the intermediate transfer recording medium is conveyed while fixing it in the width direction by nipping at least both side ends from the front surface and the back surface sides thereof, thus preventing the intermediate transfer recording medium from being shrunk in the width direction. FIGS. 3 to 6 show important portions of the printing section and the other portions are substantially the same as those of the first embodiment. Of these Figs., FIGS. 3 to 5 represent an example in which only the both side ends of the intermediate transfer recording medium are fixed, and FIG. 6 represents an example in which all periphery of an image, including upstream and downstream sides other than both the side ends, is fixed.

Figure 3A:
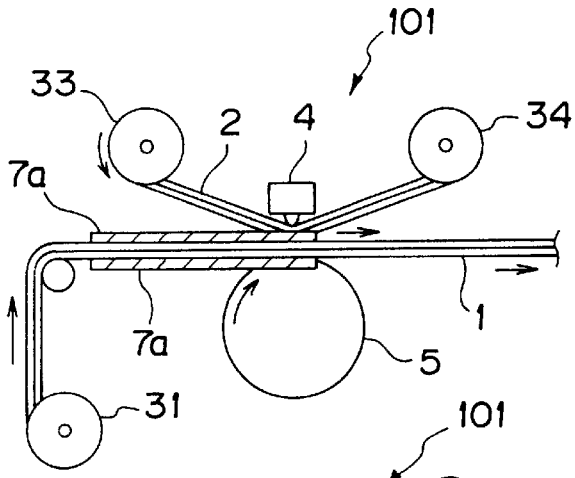
FIG. 3A represents a print starting time and FIG. 3B represents a print finishing time.
Figure 3B:
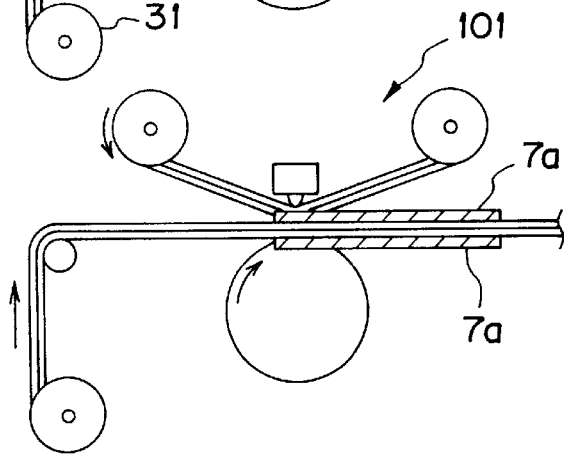

FIG. 3 is a side sectional view showing positions of the fixing plates 7*a* and 7*b* before and after the formation of the image of one color. That is, FIG. 3A shows a printing starting time, and FIG. 3B shows a printing finishing time. FIG. 4 is a plan view viewed from the upper portion thereof, and FIG. 5 is a perspective view thereof. The fixing plates take a printing starting position in FIG. 4, and take a printing intermediate position in FIG. 5.

In the second embodiment shown in FIGS. 3 to 5, means for preventing the intermediate transfer recording medium from being shrunk is provided with two pairs (7*a* and 7*b*) of fixing plates, each having a rectangular section, arranged at portions near both the ends of the intermediate transfer recording medium in parallel to the conveying direction thereof. The fixing plates are driven at the printing time by a driving mechanism, not shown, so as to nip and press the intermediate transfer recording medium from its front surface and back surface sides and simultaneously move in accordance with the conveyance of the intermediate transfer recording medium.

In the case of the multi-color printing, when the intermediate transfer recording medium is returned backward in order to print with different color, the fixing plates are also returned together with the intermediate transfer recording medium while pressing it, and when the color image is newly printed to the next intermediate transfer recording medium, the fixing plates separate from the intermediate transfer recording medium on which the image has been completely formed at the printing finishing position and return to the printing starting position shown in FIG. 3A. It is preferred that the two pairs of the fixing plates have longitudinal length corresponding to the length of one image surface. It may be possible that one pair of the fixing plates have no length corresponding to the length of one image surface as shown in FIG. 3, and a plurality pairs of the short fixing plates are arranged so as to correspond the length of one image surface. In the second embodiment, it is desired that both the side ends of the intermediate transfer recording medium are fixed in the portion printed by the thermal head and, therefore, that the intermediate transfer recording medium preferably has a wide transverse width as shown in FIG. 3 to 5 in consideration of the side end fixing thereof. That is, it is desired for the intermediate transfer recording medium to have blank portions at both the sides which are not printed.

As a modification of the above second embodiment, FIG. 6 shows a thermal transfer recording apparatus 102 in which the entire periphery of the image is fixed by pressing and nipping the intermediate transfer recording medium from its front surface and back surface sides by means of a pair of front and back fixing plates 7*c* having rectangular front surface, rectangular section and inner hollow portion to provide a frame shape.

These fixing plates 7*a* to 7*c* are moved, by the driving mechanism not shown in FIGS., in parallel to the conveying direction of the intermediate transfer recording medium while nipping it at a speed synchronizing with the conveying speed thereof. Otherwise, the fixing plates may be constructed so as to be freely movable in parallel to the conveying direction by means of guide groove or the like guide means, and to nip the intermediate transfer recording medium only at a time when it is necessary to transfer the image to the intermediate transfer recording medium.

Figure 7:
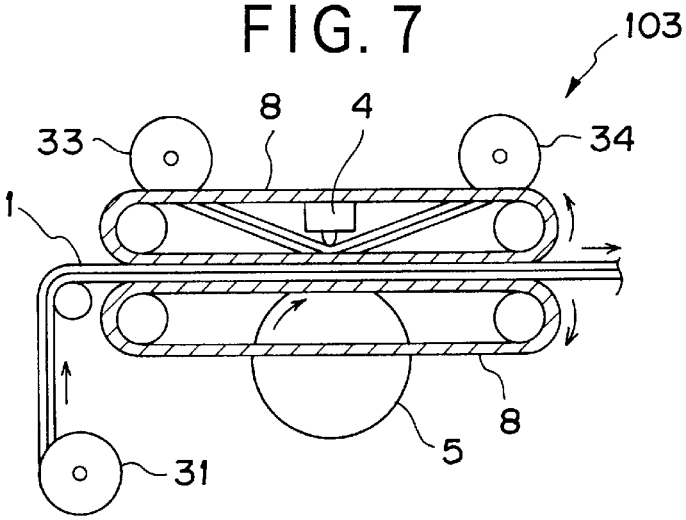
FIG. 7 is a schematic sectional view, partially cut away, showing a general arrangement of a thermal transfer recording apparatus for performing a thermal transfer recording method according to a third embodiment of the present invention.
Figure 8:
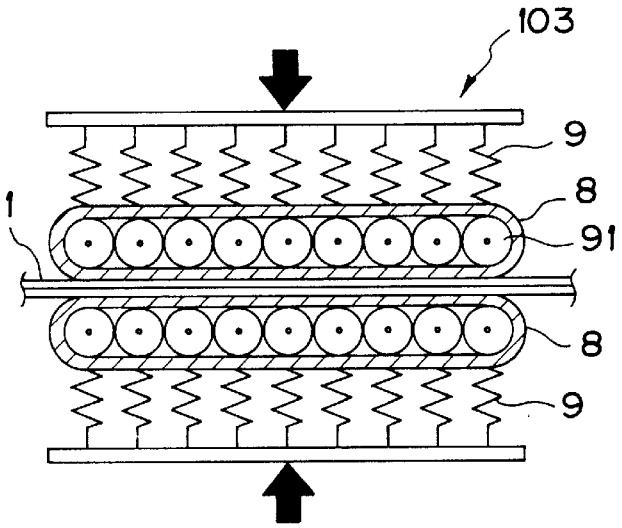
FIG. 8 is a sectional view of an important portion of the apparatus of FIG. 7 taken along the line parallel to a conveying direction.
Figure 9:
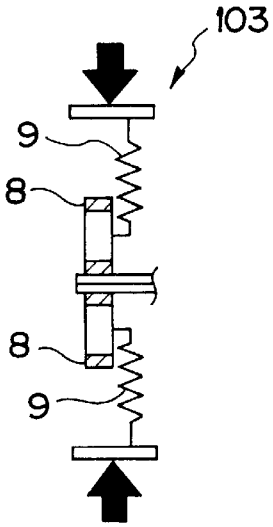
FIG. 9 is also a sectional view taken along the line normal to the conveying direction.

The third embodiment of the present invention will be described hereunder with reference to FIGS. 7 to 9.

In the third embodiment, as like in the second embodiment, the intermediate transfer recording medium is conveyed while fixing the width directional distance thereof by nipping at least both of the width directional ends of the intermediate transfer recording medium from its front surface and back surface sides, to thereby prevent the intermediate transfer recording medium from being shrunk in its width direction. In this embodiment, rotational belt means is utilized as the fixing means in substitution for the fixing plates in the former embodiment which are movable in parallel to the conveying direction of the intermediate transfer recording medium. FIGS. 7 to 9 show the important portions, namely the printing section, and other portions are substantially the same as those in the first embodiment. As in the thermal transfer recording apparatus 103 shown in FIG. 7, that of the third embodiment is provided with at least two pair of the belt means 8 (only one pair thereof is shown) which nip the intermediate transfer recording medium 1 at both of width directional ends thereof in the printing section. Each pair of the belt means 8 are driven by means of driving mechanism, not shown, so as to nip and press either one of the width directional side of the intermediate transfer recording medium 1 from its front surface and back surface sides, and simultaneously rotate in a direction parallel to the conveying direction of the intermediate transfer recording medium while synchronizing with the conveyance thereof. In the case of multi-color image, when the intermediate transfer recording medium is returned backward, the belt means is rotated reversely while pressing the intermediate transfer recording medium, or moved in a direction apart from the front surface and the back surface sides of the intermediate transfer recording medium by a moving mechanism, not shown. The belt means presses the intermediate transfer recording medium along the length sufficient to fix both the width directional ends thereof on both the upstream and downstream sides other than the heating central portion where the thermal head is disposed. When the belt means has a strong nipping and pressing force, it is preferred for the driving of the belt to be self-driven in accordance with the conveying speed of the intermediate transfer recording medium in the viewpoint of smooth conveying thereof. On the other hand, in the case of weak nipping and pressing force, the belt means may be freely rotated without performing the self-driving, providing a simple mechanical structure.

The pressing force for nipping and fixing the intermediate transfer recording medium can utilize an elastic force by using an elastic material such as rubber for forming the belt means. Furthermore, as shown in FIG. 8 and FIG. 9, coil-shaped spring means 9 may be utilized as means for applying the elastic pressing force. FIG. 8 is a sectional view taken along the conveying direction of the intermediate transfer recording medium, and FIG. 9 is a sectional view of one end side perpendicular to the conveying direction. In FIGS. 8 and 9, the belt means 8 is rotated in the conveying direction through the guidance of a number of bearings 91.

Further, the pressing force may be applied by, other than the urging force of the coil-shaped spring 9, a plate spring, pneumatic pressure, rubber elasticity, magnetic force, or the like. It is preferred that the belt means is formed of a material having an elasticity and capable of pressing the intermediate transfer recording medium from the front surface and back surface sides thereof in a tight-contact state. Further it is preferred and that the surfaces of the belt means contacting the intermediate transfer recording medium are formed of a material hard to slip such as rubber or having an adhesive property.

The belt means is brought into contact with the intermediate transfer recording medium at least on a transverse position forming the image by the heating of the thermal head, and preferably on the downstream side after the heating in addition to the transverse position, and more preferably on the upstream side before the heating in addition to the transverse position and the downstream side.

In this third embodiment, it is preferred that the intermediate transfer recording medium has a wide transverse width suitable for the fixing of the belt means.

The fourth embodiment of the present invention will be described hereunder with reference to FIGS. 10 to 15.

Figure 10:
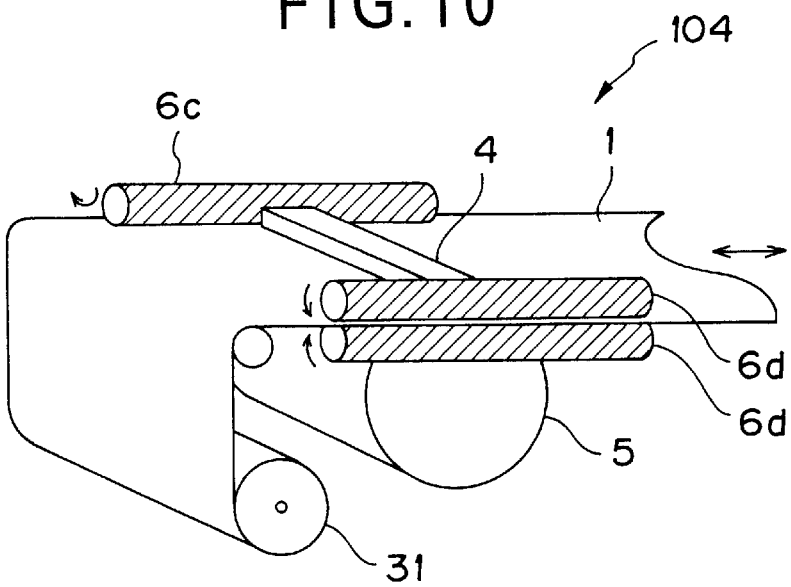
FIG. 10 is a perspective view showing an important portion of a thermal transfer recording apparatus for performing a thermal transfer recording method according to a fourth embodiment of the present invention.
Figure 11:
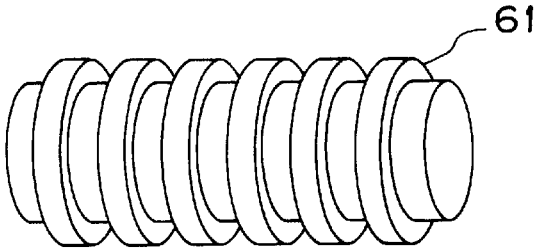
FIG. 11 is perspective view of a nip roller used for the apparatus of FIG. 10, the nip roller being provided with annular protruded portions.
Figure 14:
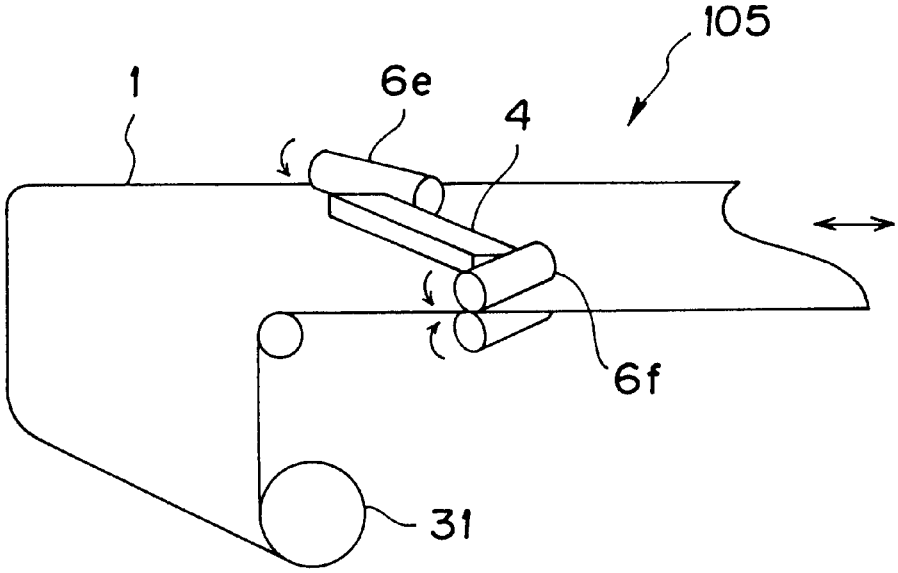
FIG. 14 a schematic perspective view of a modification of the fourth embodiment FIG. 10.
Figure 15:
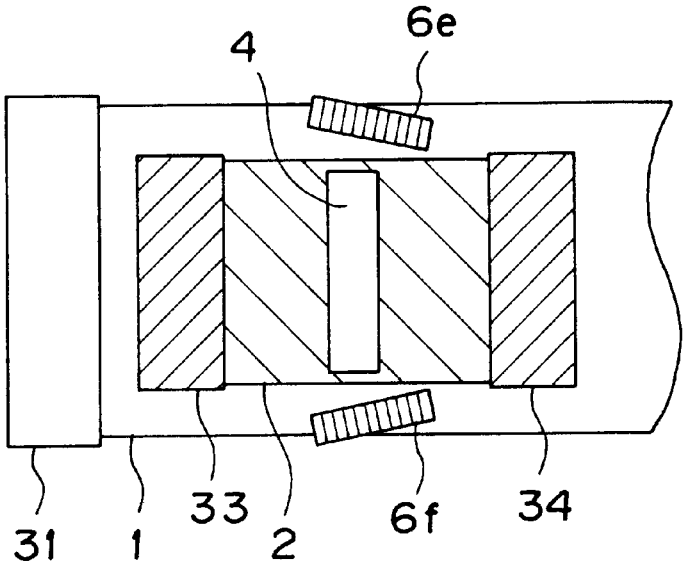
FIG. 15 is a schematic plan view of FIG. 14.

In the fourth embodiment, the nip rollers are utilized as in the first embodiment, but the arrangement of the nip rollers is different such that the rotational shafts thereof are not substantially perpendicular to the conveying direction of the intermediate transfer recording medium and are made parallel thereto (FIG. 10), or inclined to the conveying direction (FIGS. 14 and 15), and is rotatable by a driving mechanism, not shown, so as to apply a tension force to the width direction thereof. FIGS. 10, 14 and 15 show only the important portions, namely the printing section of the thermal transfer recording apparatus, and the other portions are substantially the same as those in the first embodiment. As shown in FIG. 10, two pairs (6*c*/6*c*, 6*d*/6*d*) of rotatable nip rollers are arranged at the both sides of the thermal head 4 and the upstream and downstream sides from the both sides of the thermal head 4 in substantially parallel to the conveying direction of the intermediate transfer recording medium. The nip rollers in this fourth embodiment, as is understood from the drawings, are slidably rotatable with respect to the intermediate transfer recording medium in a direction applying a tension to both sides in the width direction of the intermediate transfer recording medium (arrowed the rotating direction in FIG. 10).

It is necessary for the nip rollers to be slid under the condition pressing the intermediate transfer recording medium, and therefore necessary for the nip roller surfaces to have a suitable sliding property. As the nip rollers for the fourth embodiment, there may be used the same nip rollers as those for the first embodiment. Otherwise, in view of the suitable sliding property, a nip roller the surface of which is covered with fluororesin is preferably used. Furthermore, in this embodiment, it is necessary that a nipping pressure applied by each pair of nip rollers is reduced in comparison with that in the first embodiment. More specifically, the nipping pressure is normally reduced to 50 to 95% with respect to that in the first embodiment, preferably 70 to 90%.

Figure 12:
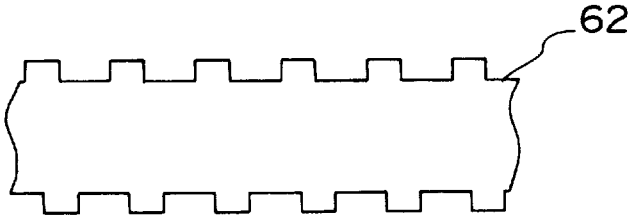
FIG. 12 is a sectional view of another nip roller of ball screw type including a rotational axis.
Figure 13:
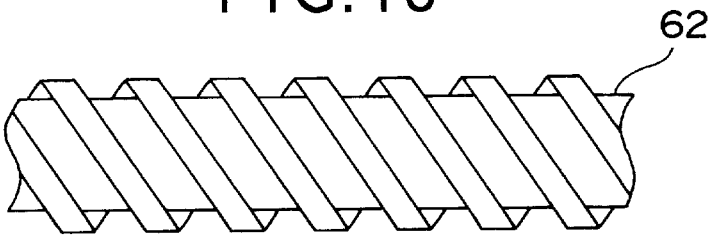
FIG. 13 is a side view of the nip roller of FIG. 12.

In another way for improving of the sliding property, the contacting area of the roller surface is decreased, and simultaneously, the sufficient contacting length thereof is kept in the conveying direction. For example, as shown by a perspective view of FIG. 11, the nip roller 61 may be formed so as to provide an irregular surface. Otherwise, the nip roller 62 may be formed, as shown in FIGS. 12 and 13, so as to provide a ball-screw-shape outer appearance having a spiral irregular shape. FIG. 12 is a sectional view of the nip roller 62 including a rotational shaft and FIG. 13 is a side view thereof.

In the case of the multi-color image, when the intermediate transfer recording medium is returned backward in order to be printed with different color, the nip rollers are left pressing, or separated from the front and back surfaces of the intermediate transfer recording medium by means of a moving mechanism, not shown.

The nip rollers are brought into contact with the intermediate transfer recording medium at least on a transverse position forming the image by the heating of the thermal head, and preferably on the downstream side after the heating in addition to the transverse position, and more preferably on the upstream side before the heating in addition to the transverse position and the downstream side so that the tension is entirely applied.

The appropriate tension in the width direction differs in accordance with the contacting area of the nip rollers and the friction coefficient of the roller surface, and it is desirable that the tension to be applied is adjusted, in consideration of the pressing force of the nip roller and the rotational speed thereof, to a value corresponding to the shrinking force caused by the heating of the thermal head.

A modified example of the fourth embodiment will be described hereunder with reference to the perspective view of FIG. 14 and the plan view of FIG. 15.

In this modified example, the nip rollers 6*e* and 6*f* are not arranged in parallel to the conveying direction of the intermediate transfer recording medium, and arranged so as to have inclinations with respect to the conveying direction. According to such arrangement, the rotating direction of the nip roller has two of directional component, namely a directional component which is normal to the conveying direction of the intermediate transfer recording medium and directed toward both sides thereof, and another directional component which advances along the intermediate transfer recording medium conveying direction. Further, in this arrangement, although an extra space for the inclined arrangement may be required, the intermediate transfer recording medium will be more smoothly conveyed in comparison with the nip roller arrangement of FIG. 10.

It is to be noted that although the thermal transfer recording method and apparatus utilizing the intermediate transfer recording medium of the present invention is described above by way of preferred embodiments with reference to the drawings, the present invention is not limited to the described embodiments and other changes or modifications may be made.

Hereunder, the intermediate transfer recording medium utilized for the thermal transfer recording method and apparatus of the present invention will be further described in detail.

It is to be first noted that, in the present invention, the type or kind of the intermediate transfer recording medium is not specifically defined as far as it has functions that the color material to be transferred from the thermal transfer sheet can be temporarily maintained and the color material is thereafter transferred to the transfer-receiving material. In the following description, an intermediate transfer recording medium utilized for the sublimation transfer recording system will be explained as one preferred example.

Figure 16:
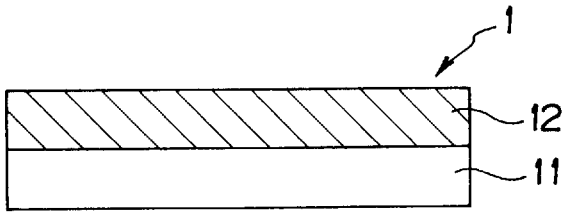
FIGS. 16 to 19 are schematic sectional views showing examples of various structures of an intermediate transfer recording medium usable for the present invention.

The intermediate transfer recording medium 1 is composed of, as shown in FIG. 16, a substrate sheet 11 and at least a receptor layer 12 disposed on one surface of the substrate sheet 11 so as to be peelable, namely transferable, therefrom.

The substrate sheet 11 for the intermediate transfer recording medium may be formed of a material which can be used for a conventional thermal transfer sheet, because the intermediate transfer recording medium is considered as a second thermal transfer sheet with respect to the transfer-receiving material. The material is, for example, oriented or non-oriented resin films made of various kinds of plastic which include polyester resin such as polyethylene terephthalate, polyethylene naphthalate and polybutylene terephthalate; a resin having high heat-resisting property such as polycarbonate, polyphenylene sulfide, polyetherether ketone, polyether sulfone and polyimide; olefin base resin such as polyethylene, polypropylene, polymethylpentene and polyethylene series copolymer; cellulose base resin such as cellrose acetate; chlorine containing resin such as polyvinyl chloride and polyvinylidene chloride; polystyrene; polyamide; and ionomer, and otherwise, thin papers such as glassine paper, condenser paper and paraffin paper, and furthermore, laminated material of the above materials.

The thickness of the substrate sheet is decided in consideration of the strength, heat conductivity, heat-resisting property and the like, and it is usually desired for the substrate sheet to have a thickness of 1 to 10 $\mu$m. According to the present invention, the shrinkage in dimension of the substrate sheet can be reduced even if a substrate sheet is formed of a conventional material, and moreover, even in a case where a material having a large dimension shrinkage is used, the dimension shrinkage like in the conventional one can be realized.

The receptor layer 12 is formed of at least binder resin, and in addition as occasion demand, various additives such as releasing agent may be added. As the binder resin, there is preferably used that having a good dyeing property to the sublimation dye. The binder resin is, for example, polyolefin group resin such as polypropylene; halogen containing resin such as polyvinyl chloride and polyvinylidene chloride; vinyl group resin such as polyvinylacetate and polyacrylic ester; polyester resin such as polyethylene terephthalate and polybutylene terephthalate; polystyrene group resin; polyamide group resin; copolymer of olefin (such as ethylene and propylene) and other vinyl monomer; ionomer; and cellulose derivative. In these material, the vinyl group resin and polyester group resin may be preferably used. In order to prevent the receptor layer from being thermally fused to the thermal transfer sheet, it will be desired to add a releasing agent to the binder resin. As the releasing agent, there will be used a silicone oil, phosphoric ester group surface active agent and fluorine compound, and the silicone oil will be more preferred. It is desired that the amount of the releasing agent to be added is preferably in a range of 0.2 to 30 weight parts with respect to 100 weight parts of the binder resin for forming the receptor layer.

The receptor layer is formed on the substrate sheet by applying the coating liquid or the ink which is prepared by the above binder and additives such as the release agent are dissolved or dispersed in a solvent such as water and organic solvent onto the substrate sheet through any one of known method, for example, known coating methods such as the gravure coating method, the gravure reverse coating method and the bar coating method; and known printing method such as the gravure printing method and silk screen printing method. It is preferred that the receptor layer has a layer thickness of 0.1 to 10 μm.

Figure 17:
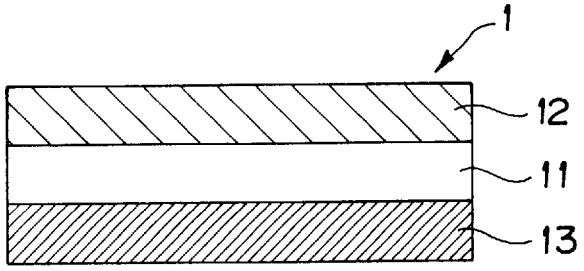

Furthermore, as shown in FIG. 17, in the intermediate transfer recording medium 1, a backing layer 13 may be formed on the other surface of the substrate sheet 11, for the purpose of preventing the intermediate transfer recording medium 1 from being thermally fused to a heating means such as thermal head or heating roller and improving the sliding performance thereof.

The backing layer 13 is formed of a resin such as cellulose base resin such as ethyl cellulose, hydroxycellulose, hydroxypropyl cellulose, methyl cellulose, cellulose acetate, cellulose acetate butyrate and nitrocellulose; vinyl group resin such as polyvinyl alcohol, polyvinyl acetate, polyvinyl butyral, polyvinyl acetal and polyvinyl pyrrolidone; acrylic group resin such as polymethylmethacrylate, polyethylacrylate, polyacrylamide and acrylonitrile-styrene copolymer; polyamide resin; vinyltoluene resin; coumarone-indene resin; polyester group resin; polyurethane group resin; silicone-modified urethane resin; fluorine-modified urethane resin; and mixture thereof.

The backing layer 13 for preventing the thermal fusing is preferably formed of crosslinking resin by selecting a resin having a reactive group such as hydroxyl group from the above-mentioned resins, and using a crosslinking agent in combination therewith. Furthermore, in order to provide heat-resistively sliding ability for the backing layer and improve sliding ability against the heating device such as thermal head, solid or liquid releasing agent or lubricant may be added to the backing layer. As such releasing agent or lubricant, there may be used, for example, various waxes such as polyethylene wax and paraffin wax; higher fatty acid alcohol; organopolysiloxane; anionic group surface active agent; cationic group surface active agent; amphoteric surface active agent; nonionic group surface active agent; fluorine group surface active agent; organic carboxylic acid and its derivative; fluorine group resin; silicone group resin; and fine particles of inorganic compound such as talc or silica. The lubricant is added by an amount of 5 to 50 weight %, preferably 10 to 30 weight %, with respect to all solid component of the backing layer. The backing layer is formed by substantially the same manner as that of the receptor layer to provide a thickness preferably of 0.1 to 10 μm.

Figure 18:
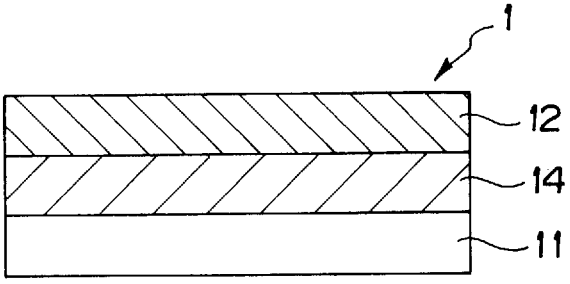

Furthermore, as shown in FIG. 18, a release layer 14 may be formed between the substrate sheet 11 and the receptor layer 12 in order to control the peeling ability of the receptor layer with respect to the substrate sheet. This release layer 14 is a layer which remains on the substrate sheet at the time of peeling the receptor layer. The release layer 14 is formed of a material prepared by adding a releasing material to the binder resin as occasion demands or a resin having a releasing property. The binder resin is formed of, for example, acrylic group resin; vinyl group resin such as polyvinyl acetate and vinyl chloride—vinyl acetate copolymer; cellulose group resin such as nitrocellulose; polyester resin; and thermosetting resin such as urethane resin, unsaturated polyester resin and aminoalkyd resin. The releasing material is, for example, various wax; silicone oil; silicone resin; and fluorine resin. Resin having a releasing property is, for example, silicone group resin; melamine resin; and fluorine resin. It is preferred that the release layer has a thickness of 1 to 5 μm.

Figure 19:
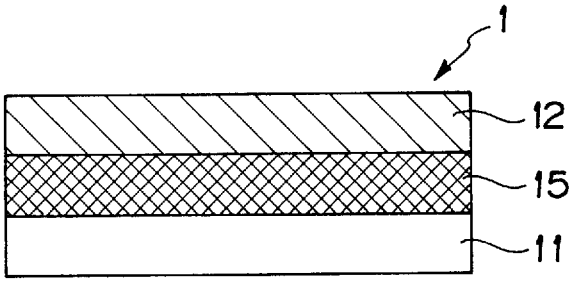
Figure 20:
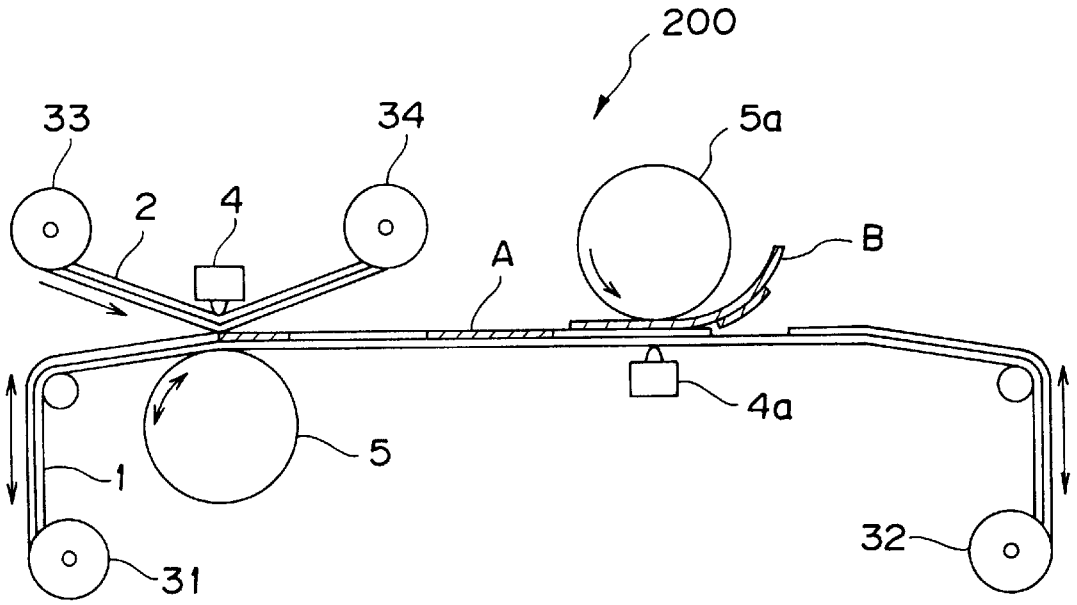
FIG. 20 PRIOR ART
FIG. 20 is a view similar to that of FIG. 1 representing an arrangement of a conventional thermal transfer recording apparatus using an intermediate transfer recording medium.

As shown in FIG. 19, in order to protect the receptor layer 12 after it is the transferred to the transfer-receiving material together with the image, a protector layer 15 may be formed between the substrate sheet 11 and the receptor layer 12,. This protector layer 15 is transferred from the intermediate transfer recording medium to the transfer-receiving material, and is positioned above the receptor layer 12 after the transferring. The formation of the protector layer 15 can improve the durability of the image against an ambient atmosphere, finger prints and chemicals. The protector layer is at least formed of a binder resin such as cellulose group resin such as nitrocellulose; acrylic group resin; vinyl group resin such as vinyl chloride—vinyl acetate copolymer; thermosetting resin such as urethane resin, unsaturated polyester resin and aminoalkyd resin; and ionizing radiation setting resin which are hardened by ultraviolet rays or electron beams. It is preferred that the protector layer has a thickness of 1 to 20 μm. In a certain case, both the protector layer 15 and the release layer may be formed.

Either one of known thermal transfer sheet of photosensitive sublimation transfer system or that of heat sensitive fusion transfer system may be utilized for the thermal transfer recording method and apparatus of the present invention. In the sublimation transfer system, only the dye in the color material layer is transferred by heating to thereby form the image, and in the heat sensitive fusion transfer system, the color material is transferred together with the binder, that is, the color material layer which contains the color material and the binder in a fused state is transferred, to thereby form the image with the color material layer. Although the present invention is applicable to both the transfer systems, in the latter system, since the color material layer is also transferred to the transfer-receiving material, the surface of the transfer-receiving material may be embedded by the color material even if the surface of the transfer-receiving material provides an irregular surface condition. On the other hand, in the former system, since only the color material is transferred, the irregular surface of the transfer-receiving material, if existing, directly effects to the image quality. In this viewpoint, the present invention is more preferably applied to the heat sensitive sublimation transfer system.

According to the thermal transfer recording method and apparatus of the present invention, the printing operation can be performed in a state that the intermediate transfer recording medium is nipped at front and rear portions of the location of the thermal head or both the width directional ends thereof during the conveying and the printing of the intermediate transfer recording medium. Therefore, even if the thin substrate sheet is used for the intermediate transfer recording medium, the shrinkage of the substrate sheet which is caused by high heat of the thermal head at the printing time is prevented. As a result, in recording the multi-color image such as yellow, magenta and cyan, the printed sizes of the respective color images are not shifted and can be exactly overlapped, thus providing an improved color reproduction ability and recording the color image with high quality.

It is to be noted that the present invention is not limited to the described embodiments and many other changes and modifications may be made without departing from the scopes of the appended claims.

What is claimed is:

1. A thermal transfer recording method comprising:

providing a thermal transfer sheet comprising a substrate sheet and a color material layer for transferring a color material, through either one of sublimation transfer process or heat transfer fusion process which is disposed on one surface of said substrate sheet, and providing an intermediate transfer recording medium having long-scale comprising another substrate sheet and a receptor layer disposed on one surface of said another substrate sheet so as to be transferable;

disposing the thermal transfer sheet together with the intermediate transfer recording medium between a heating means and a platen roller under pressure so that a color material layer for a first color of the thermal transfer sheet and the receptor layer, at an image forming portion of the intermediate transfer recording medium are overlapped;

heating the heating means in accordance with an image information to be printed to thereby transfer at least the color material of the color material layer to the receptor layer to form said image of said first color a said image forming portion;

forming an image of second or succeeding color on said image forming portion to which the first image of the first color is formed by repeating at least one time of the same image forming manner as that for the first color image formation to thereby form an overlapped image on said image forming portion for the first color image; and transferring the thus formed overlapped image together with the receptor layer to a transfer receiving material, wherein when said image forming portion of the intermediate transfer recording medium passes a printing position formed by the heating means and the platen roller, the image of each color is formed by heating the heating means while nipping at least one portion of the intermediate transfer recording medium by a shrinkage preventing means, at a position near the printing position, so as to apply a tension to prevent thermal shrinkage of the image forming portion of the intermediate transfer recording medium in the width direction thereof.

2. A thermal transfer recording method according to claim 1, wherein said heating means is a thermal head.

3. A thermal transfer recording method according to claim 1, wherein when the image forming portion of the intermediate transfer recording medium passes the printing position formed by the heating means and the platen roller, the image is formed while nipping across the intermediate transfer recording medium at a portion near the printing position by at least two pairs of nip rollers, in which at least a pair of nip rollers are positioned at positions near upstream and downstream sides respectively of the printing position from front surface side and back surface side to thereby prevent the intermediate transfer recording medium from being shrunk in the width direction thereof.

4. A thermal transfer recording method according to claim 3, wherein said two pair of nip rollers are arranged to be substantially normal to the intermediate transfer recording medium conveying direction.

5. A thermal transfer recording method according to claim 1, wherein when an image forming portion of the intermediate transfer recording medium passes a printing position formed by the heating means and the platen roller, the image is formed by nipping portions near both ends in the width direction of the intermediate transfer recording medium between portions near upstream and downstream sides of the printing position and conveying the intermediate transfer recording medium so as to fix a width directional distance with a relative positional relationship between both ends of the intermediate transfer recording medium in a width direction thereof to thereby prevent the intermediate transfer recording medium from being shrunk in the width direction thereof.

6. A thermal transfer recording method according to claim 1, wherein when an image forming portion of the intermediate transfer recording medium passes a printing position formed by the heating means and the platen roller, the image is formed by pressing portions near both ends in the width direction of the intermediate transfer recording medium between portions near upstream and downstream sides of the printing position from front and back surface sides at a portion near the printing position while applying a width directional tension to the intermediate transfer recording medium so as to fix a relative positional relationship between both ends of the intermediate transfer recording medium in a width direction thereof to thereby prevent the intermediate transfer recording medium from being shrunk in the width direction thereof.

7. A thermal transfer recording method according to claim 6, wherein the image is formed by pressing said portions near both ends in the width direction of the intermediate transfer recording medium by nip rollers disposed on both sides of the printing position obliquely with respect to the conveying direction of the intermediate transfer recording medium while fixing a relative positional relationship between both ends of the intermediate transfer recording medium in a width direction thereof.

8. A thermal transfer recording apparatus comprising:

a conveying means for conveying a thermal transfer sheet comprising a substrate sheet and a color material layer for transferring a color material through either one of sublimation transfer process or a heat fusion transfer process which is disposed on one surface of the substrate sheet;

an other conveying means for conveying an intermediate transfer recording medium having long-scale comprising another substrate sheet so as to be transferable;

a heating means for pressing the thermal transfer sheet and the intermediate transfer recording medium against a platen roller so as to overlap a color layer of the thermal transfer sheet and a receptor layer on an image forming portion of the intermediate transfer recording medium with each other and generating a heat in accordance with an image information of an image to be printed to thereby transfer at least the color material of the color material layer to the receptor layer, thereby forming the image thereon;

a retiring means for retiring the intermediate transfer recording medium so as to return the image forming portion, to which an image of a first color is formed by the heating means, to a printing position formed by the heating means and the platen roller and repeating at least one time of the image information process by the heating means to thereby carry out an overlapped printing of an image of second or succeeding color to the image forming portion on which the first color image is formed;

a shrinkage preventing means for preventing thermal shrinkage of the intermediate transfer recording medium, at a time when the image forming portion of the intermediate transfer recording medium passes the printing position, while nipping at least one portion of the intermediate transfer recording medium, at a position near the printing position, so as to apply a tension to prevent thermal shrinkage of the image forming portion of the intermediate transfer recording medium in the width direction thereof, to thereby form an image of each color; and a transferring means for transferring the image together with the receptor layer to a transfer receiving material.

9. A thermal transfer recording apparatus according to claim 8, wherein said heating means is a thermal head.

10. A thermal transfer recording apparatus according to claim 8, wherein said shrinkage preventing means comprises at least two pairs of nip rollers positioned at positions near upstream and downstream sides respectively of the printing position formed by the heating means and the platen roller at an angle substantially normal to a conveying direction of the intermediate transfer recording medium so as to nip while rotating, across the intermediate transfer recording medium from surface said and back surface side thereof.

11. A thermal transfer recording apparatus according to claim 8, wherein said shrinkage preventing means comprises at least two pairs of fixing plates which nip the intermediate transfer recording medium at portions near both ends in the width direction thereof and which are moveable in parallel to the intermediate recording medium conveying direction between the upstream and downstream sides of the printing position formed by the heating means and the platen roller.

12. A thermal transfer recording apparatus according to claim 8, wherein said shrinkage preventing means comprises at least two pairs of belts which nip the intermediate transfer recording medium at portions near both ends in the width direction thereof and which are rotatable in parallel to the intermediate recording medium conveying direction between the upstream and downstream sides of the printing position formed by the heating means and the platen roller.

13. A thermal transfer recording apparatus according to claim 8, wherein said shrinkage preventing means comprised at least two pairs of nip rollers being positioned at both ends sides of the printing position formed by the heating means and the platen roller and being slidably rotatable in directions towards both ends of the intermediate transfer recording medium while nipping the same at portions near both ends in the width direction thereof to thereby apply a width directional tension to the intermediate transfer recording medium.

14. A thermal transfer recording apparatus according to claim 13, wherein said two pairs of nip rollers are arranged so as to provide inclinations with respect to the intermediate transfer recording medium conveying direction.

* * * * *